US007832990B2

(12) United States Patent
Bootle

(10) Patent No.: US 7,832,990 B2
(45) Date of Patent: Nov. 16, 2010

(54) MEASUREMENT DEVICE

(75) Inventor: Geoffrey Bootle, Maidstone (GB)

(73) Assignee: Delphi Technologies Holding S.arl, Troy, MI (US)

( * ) Notice: Subject to any disclaimer, the term of this patent is extended or adjusted under 35 U.S.C. 154(b) by 1134 days.

(21) Appl. No.: 11/501,384

(22) Filed: Aug. 9, 2006

(65) Prior Publication Data

US 2007/0065297 A1 Mar. 22, 2007

(51) Int. Cl.
*F04B 49/00* (2006.01)
*G01M 19/00* (2006.01)

(52) U.S. Cl. ..... 417/63; 73/168; 73/114.41

(58) Field of Classification Search ..... 417/63; 73/168, 114.41; 123/445–450, 495–502
See application file for complete search history.

(56) References Cited

U.S. PATENT DOCUMENTS 2,776,494 A * 1/1957 Sheppard ..... 33/611
3,702,577 A * 11/1972 Staudt et al. ..... 92/15
4,348,895 A * 9/1982 Straubel et al. ..... 73/114.41
4,385,867 A * 5/1983 Straubel et al. ..... 417/63
4,435,128 A * 3/1984 Frey et al. ..... 417/63
4,455,865 A * 6/1984 Davenport et al. ..... 73/114.28
4,499,757 A * 2/1985 Backe et al. ..... 73/114.41
4,573,348 A * 3/1986 Abramson et al. ..... 73/115.02
4,655,689 A 4/1987 Westveer et al.
4,656,990 A * 4/1987 Miyaki et al. ..... 123/494
4,746,859 A * 5/1988 Malik ..... 324/207.12
4,785,242 A * 11/1988 Vaidya et al. ..... 324/207.25
6,272,910 B1 * 8/2001 Noland ..... 73/114.79

FOREIGN PATENT DOCUMENTS

FR 2102867 4/1972
FR 2329970 5/1977
FR 2500924 9/1982

* cited by examiner

*Primary Examiner*—Devon C Kramer
*Assistant Examiner*—Christopher Bobish
(74) *Attorney, Agent, or Firm*—Thomas N. Twomey

(57) ABSTRACT

The invention provides a method for determining the angular position of a pump shaft relative to a pump body. The method comprises: providing the pump shaft with a first locating feature; providing the pump shaft with a second locating feature; providing a measurement device provided with a measurement member; engaging the measurement member with the first locating feature and determining a first distance between the first locating feature and a reference feature provided on the measurement device; engaging the measurement member with the second locating feature and determining a second distance between the second locating feature and a reference feature provided on the measurement device; and determining the difference between the first and second distances to provide an indication of the angular position of the pump shaft relative to the pump body. The invention also provides apparatus suitable for performing the above method.

29 Claims, 10 Drawing Sheets

MEASUREMENT DEVICE

TECHNICAL FIELD

The present invention relates to a measurement device. More particularly, but not exclusively, the invention relates to device and method that permits the angular position of a pump shaft of a fuel injection pump to be determined accurately, and in a repeatable manner, so as to enhance the serviceability of such pumps for compression-ignition internal combustion engines. The invention also relates to a fluid pump assembly incorporating such a measurement device for determining the angular position of a pump shaft relative to a pump body.

BACKGROUND ART

In a fuel injection system of a compression-ignition internal combustion engine, it is known to use a so-called 'distributor pump' to deliver pressurised fuel to a series of fuel injectors. The distributor pump serves the dual functions of i) pressurising the fuel to a desired injection pressure and ii) delivering a charge of pressurised fuel to each of the fuel injectors at the exact moment it is required to inject fuel into a corresponding combustion cylinder. In some vehicle applications, distributor pumps are favoured since they achieve a cost reduction over so-called 'in line' pumps that comprise a cam-driven pumping plunger unit for each fuel injector of the engine.

FIG. 1 shows a schematic view of a typical distributor-type fuel pump 2, the functionality of which would be well known to the skilled reader. The fuel pump 2 comprises a pump body or casing (not shown) within which a longitudinally extending pump shaft 4 is rotatably mounted. In use, the pump shaft 4 is driven by the drive shaft of an associated engine and so the speed of rotation of the pump shaft 4 is proportional to the speed of the engine.

The fuel pump 2 is functionally separated into a pump drive section, indicated generally as 6, which performs the role of fuel pressurisation, and a pump distributor section indicated generally as 8, which performs the role of distributing the pressurised fuel to each fuel injector.

Referring firstly to the pump drive section 6 (shown to the left in FIG. 1), the drive shaft 4 is provided with a passage 10 extending radially therethrough within which is received a pair of diametrically opposed pumping plungers 12. The pumping plungers 12 are moveable within the radial passage 10 and define a pumping chamber 14 between their opposing faces.

The pumping plungers 12 are operable to reciprocate within the radial passage 10 by way of a cam arrangement 16 which is driven by a cam ring 18. The cam arrangement 16 includes first and second cam shoes 20 that engage a respective one of the pumping plungers 12 at its radially outer end. The cam shoes 20 are shaped to receive a respective cam roller 22 in such a manner that the cam roller 22 is free to rotate in the cam shoe 20.

Although it is not clear in FIG. 1, the cam ring 16 is of annular form and its cam surface is shaped so that as the drive shaft 4 rotates, the cam rollers 22 are caused to ride over the cam surface and move radially to impart a synchronised reciprocating motion to the pumping plungers 12. Thus, as the pump shaft 4 rotates, the pumping plungers 12 are caused to move inwardly together to perform a pumping stroke, in order to force pressurised fuel out of the pumping chamber 14, and outwardly together to perform a filling stroke, in order to suck fuel into the pumping chamber 14.

Fuel flows to and from the pumping chamber 14 via a passage 24 provided in the pump shaft that communicates with the pump chamber 14 and extends longitudinally along the axis of the pump shaft 4 into the distributor section 8 of the fuel pump 2. The longitudinal fuel passage 24 conveys fuel at an injectable pressure level away from the pumping chamber 14 to the distribution section 8 when the pumping plungers 12 are performing a pumping stroke and conveys fuel at a relatively low pressure (transfer pressure) to the pumping chamber 14 from the distribution section 8 when the pumping plungers 12 are performing a filling stroke.

The end of the longitudinal fuel passage 24 located in the region of the distributor section 8 is shaped so as to turn through 90 degrees and extend radially through the pump shaft 4 to terminate at its outer surface.

The distributor section 8 includes a generally cylindrical distributor head 30 within which the pump shaft 4 is rotatable such that the distributor head 30 remains stationary relative to the pump shaft 4. The distributor head 30 is provided with a one or more distributor ports 32 (only two of which are shown, with dashed lines, in FIG. 1), the number of which corresponds to the number of injectors of the engine, typically four, six or eight. The distributor ports 32 are radially spaced around the distributor head 30 and are communicable with the passage 24 in the pump shaft 4 at discrete intervals as the pump shaft 4 rotates. In use, as the pump shaft 4 rotates so as to cause the pumping plungers 12 to perform a pumping stroke, the passage 24 moves into registration with one of the distributor ports 32. Pressurised fuel will thus be communicated to the injector that is fluidly connected to said port 32. The passage 24 will register with the other distributor ports 32 in synchronisation with the pumping strokes performed by the pumping plungers 12.

The distributor head 30 is also provided with an inlet port 34 that extends radially so as to define an opening on the outer and inner faces of the distributor head 30. Although not shown in FIG. 1, the inlet port 34 is supplied relatively low pressure fuel from a fuel transfer pump (not shown) and is communicable with a cross bore 36 provided in the drive shaft 4 that intersects the longitudinal passage 24.

As the drive shaft 4 rotates, the inlet passage 34 registers with the cross bore 36 at discrete intervals as the pumping plungers 20 perform a filling stroke. As a result, fuel is drawn from the inlet passage 34, through the cross bore 36 and longitudinal passage 24, and into the pumping chamber 14, ready for the commencement of a pumping stroke.

It is critical that the rotational timing of a distributor pump is set up correctly when the pump is installed on the engine for the first time to ensure that pressurised fuel is delivered to each cylinder of the engine at the correct moment. Similarly, it is important that a distributor pump can be disconnected from and re-connected to the engine, during maintenance for example, without adversely affecting the pump timing and, thus, performance.

It is common for a prototype sample of a fuel pump 2 to be connected to a test engine following manufacture so that the performance of the fuel pump 2 can be analysed to determined the 'correct timing position' for that specific pump. For the purposes of this specification, the correct timing position refers to the precise angular position of the pump shaft 4 that is required to deliver fuel to the cylinder that is first in the engine firing sequence (for example, No. 1 cylinder) with the cylinder piston in the top dead centre position (TDC).

Conventionally, a 'timing master pump' is created during development of a pump type for an engine. The purpose of the timing master pump is to calibrate a 'timing angle function' of a calibration test machine. Following the manufacture of a production-standard pump, the pump is calibrated on such a test machine or 'test bench', typically being electric-motor driven, to determine the correct timing position for accurate fuel delivery, and to determine the desired settings for other devices such as, for example, the engine speed governor and advance box. At the end of calibration the test bench rotates the drive shaft of the pump to the correct timing position referenced from the timing master pump and further angular rotation of the pump shaft 4 is prevented by a locking bolt (not shown in FIG. 1) that is screwed into the body of the fuel pump. Once the correct timing position has been set and the locking bolt screwed in position, the pump is suitable for delivery to an engine manufacturer.

Although the above method is adequate for setting up the correct timing position of a fuel pump prior to installation of the pump on an engine, once the fuel pump has been installed, and the lock bolt released (as required for the engine to operate), the correct timing position is lost. The Applicant has recognised that a problem exists if an engine is observed as running poorly following installation of the fuel pump as there is no means to determine whether or not the initial fuel pump timing set-up is at fault. Furthermore, if the fuel pump is removed from the engine, for maintenance purposes for example, the fuel pump cannot be correctly reinstalled since the original timing position of the drive shaft is lost. In these circumstances, the fuel pump must be returned to the manufacturer for re-calibration. This is a hindrance to the pump manufacturer and the engine manufacturer since it introduces inefficiencies, and hence cost disadvantages, into production and service procedures.

Thus, an object of the invention is to enable the correct timing position of a fuel pump to be measured accurately and reliably following pump calibration and which allows the pump shaft position to be checked and reset after the pump has been connected to the engine.

DISCLOSURE OF THE INVENTION

It is against this background that the invention provides a method for determining the angular position of a pump shaft relative to a pump body. The method comprises: providing the pump shaft with a first locating feature; providing the pump shaft with a second locating feature; providing measurement means including a measurement device provided with a measurement member; engaging the measurement member with the first locating feature and determining a first distance between the first locating feature and a reference feature provided on the measurement device; engaging the measurement member with the second locating feature and determining a second distance between the second locating feature and a reference feature provided on the measurement device; and determining the difference between the first and second distances to provide an indication of the angular position of the pump shaft relative to the pump body.

A particular advantage of the invention is that it permits the correct timing position of the fuel pump to which it is mounted to be measured conveniently with a gauge prior to installing the fuel pump on an engine. Thus, a value indicative of the angular position of the pump shaft is derivable from the difference between the first and second distances. Since the measurement device determines the distance between the first and second locating features, the reading taken thereby is resilient to part-to-part variations in the fuel pump components. This provides an advantage in terms of manufacturing since the mechanical tolerances on the pump components become less critical, thus reducing manufacturing costs.

In one mode of operation, for example in circumstances in which a reading for the correct timing position has already been obtained during an initial measurement and it is now required to re-calibrate the fuel pump following its removal from an engine, the method may include adjusting the angular position of the pump shaft so as to set the measurement member to the previously acquired reading that corresponds to the correct pump timing position. Following the re-establishment of the correct pump timing position of the pump shaft, the pump shaft may be locked against further rotation to allow for re-installation of the fuel pump on the engine.

Preferably, the steps of engaging the measurement member with the first and second locating features, respectively, includes inserting the measurement member into openings provided in the pump body.

The method of the invention has a particular advantage in circumstances in which the pump shaft has a predetermined correct timing position, wherein the pump shaft is locked into the correct timing position prior to engaging the measurement member with the first and second locating features, respectively. In these circumstances, the correct timing position of the pump shaft can be measured accurately and precisely following calibration of the fuel pump. This measurement may be recorded and stored against the fuel pump part number following manufacture and archived for future referral. Alternatively, or in addition, the measurement may be marked on the fuel pump to facilitate future checks on the pump timing position or to recalibrate the pump following a maintenance action.

In one embodiment of the invention, first and second measurement members are provided such that the engagement step comprises engaging the first measurement member with the first locating feature and engaging the second measurement member with the second locating feature. Further, it is preferred that the step of engaging the first and second measurement members includes moving the measurement members towards and away from the pump body, respectively. This permits the ends of the first and second measurement members to be disengaged from the locating features in circumstances when no measurement reading is taking place in order to protect the ends of the first and second measurement members from being damaged through inadvertent angular movement of the pump shaft.

In a second aspect, the invention provides apparatus comprising a pump having a rotatable pump shaft and measuring means for providing an indication of the angular position of the pump shaft relative to a pump body, the measuring means including means for: i) measuring a first distance between a reference feature provided on the pump body and a first locating feature provided on the pump shaft, and ii) measuring a second distance between the reference feature and a second locating feature provided on the pump shaft.

Preferably, the measuring means includes means for measuring the difference between the first and second distances to provide the indication of the angular position of the pump shaft relative to the pump body.

For convenience, it is a preferred feature that the first and second locating features are disposed at the same axial position on the pump shaft, and diametrically opposed. Disposing the locating features on the pump shaft in this manner enables convenient formation of first and second bores provided in the pump body, each bore having an axis in alignment with a respective one of the first and second locating features.

In a preferred embodiment, the measuring means includes a measuring device for receipt with the first bore so as to measure the distance between the reference feature provided on the pump body and the first locating feature provided on the pump shaft. The measuring means can also include another measuring devise received within the second bore so as to measure the distance between the reference feature provided on the pump body and the second locating feature provided on the pump shaft.

In order that the measurement device may engage with the corresponding bores of the pump body, it is preferred that the measurement device includes a positioning member provided with an external screw thread for securely engaging the corresponding bore. A screw thread is preferred to a sliding fit, for example, since it provides a more secure engagement between the measurement device and the pump body which guards against measurement errors.

The positioning member itself may include a passage for receiving a measurement member which is moveable with respect to the positioning member such that an inner end of the measurement member may be engaged and disengaged with the first or second locating feature depending on which bore the device is engaged with.

Preferably, the measurement member carries a locking member which, when in a locked position, prevents angular movement of the measurement member relative to the positioning member. An advantage of this feature is that the measurement member is locked in position with respect to the positioning member so that the device can be removed from the bore without affecting the measurement that has been taken.

In one embodiment, for convenient mounting of the measurement device on the pump body, it is preferred that the measurement device includes a positioning structure having first and second leg members, the first leg member slidably receiving the first measurement member and the second leg member slidably receiving the second measurement member. At their ends distal from the pump shaft the first and second leg members may be connected by a bridging member which provides torsional stiffness to the positioning structure.

It is a preferred feature of the invention that the device body is biased away from the positioning structure by biasing means to urge the first and second measurement members to disengage from the first and second locating features, respectively, in use. The biasing force may be overcome by an appropriate force applied by a user to cause the measurement members to engage the pump shaft. It is also preferred that the device body is moveable with respect to the positioning structure to permit the first and second measurement members to be engaged and disengaged with the first and second locating features, respectively. This provides a safety feature to guard against the first ends of the measurement members being damaged by the locating features due to inadvertent rotation of the pump shaft.

Preferably, a second end of the first measurement member protrudes from the positioning structure and attaches to the device body in a fixed manner. Still preferably, the second end of the first measurement member is received within a first bore provided in the device body. In a similar manner, it is preferred that a second end of the second measurement member protrudes from the positioning structure to connect with the device body, but in a moveable manner.

Thus, since the first measurement member is in a fixed relationship with the measurement device body, a reference distance is established to which the amount of movement of the second measurement member may be compared.

In a preferred embodiment, the measurement gauge means is provided with a measurement gauge operable to measure the amount that the second measurement member moves linearly with respect to the device body. Although different types of measurement gauge means are compatible with the invention, for example, linear encoders and digital displacement transducers, LVDTs and the like, for simplicity and accuracy it is preferred that the measurement gauge means is a dial test indicator.

BRIEF DESCRIPTION OF THE DRAWINGS

Reference has already been made to FIG. 1 of the accompanying drawing which shows a schematic view of a known distributor-type fuel pump for a diesel engine. In order that the invention may be more readily understood, reference will now be made, by way of example only, to the remaining drawings in which.

DETAILED DESCRIPTION OF PREFERRED EMBODIMENTS

Figure 1:
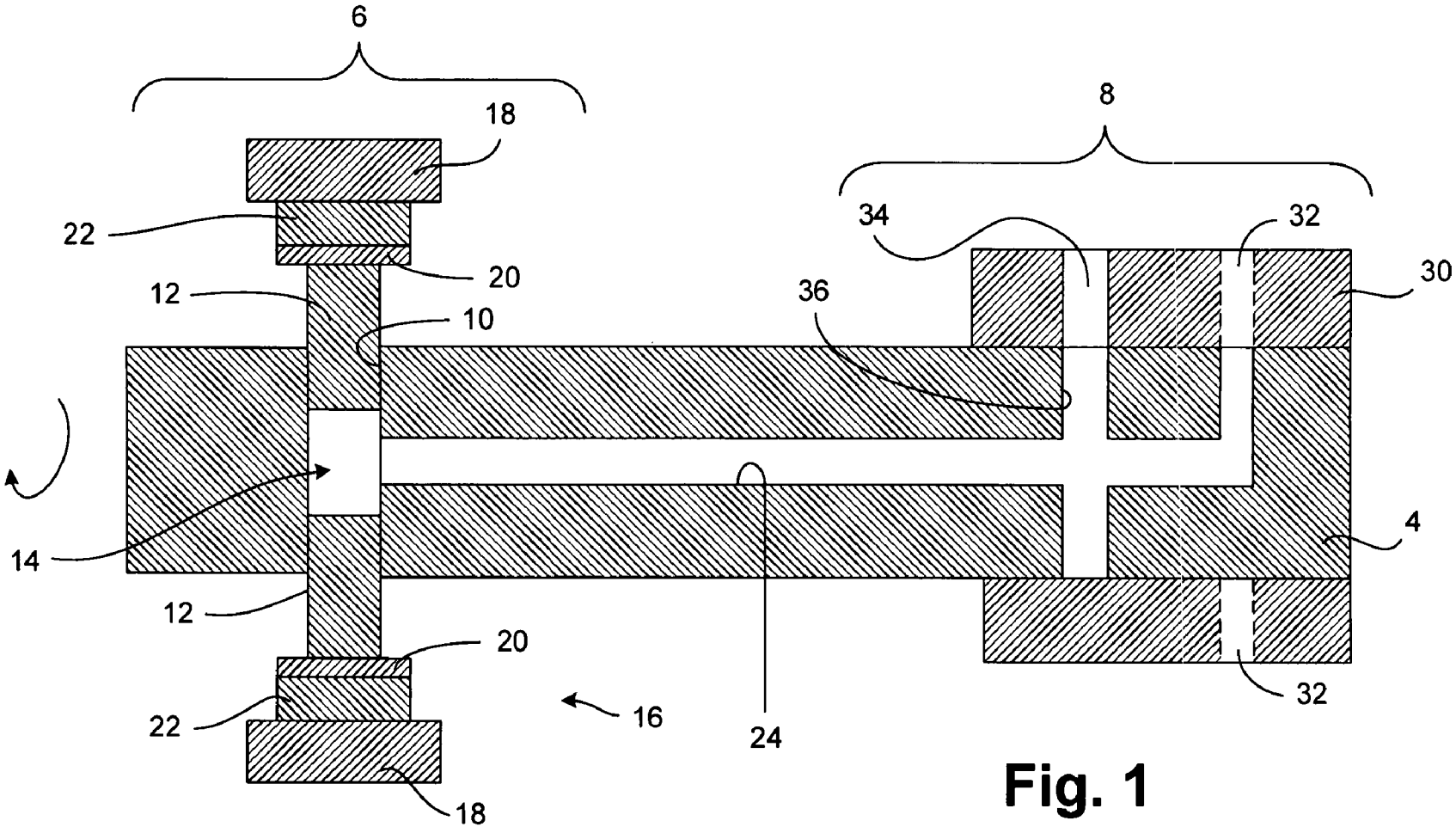
Figure 2:
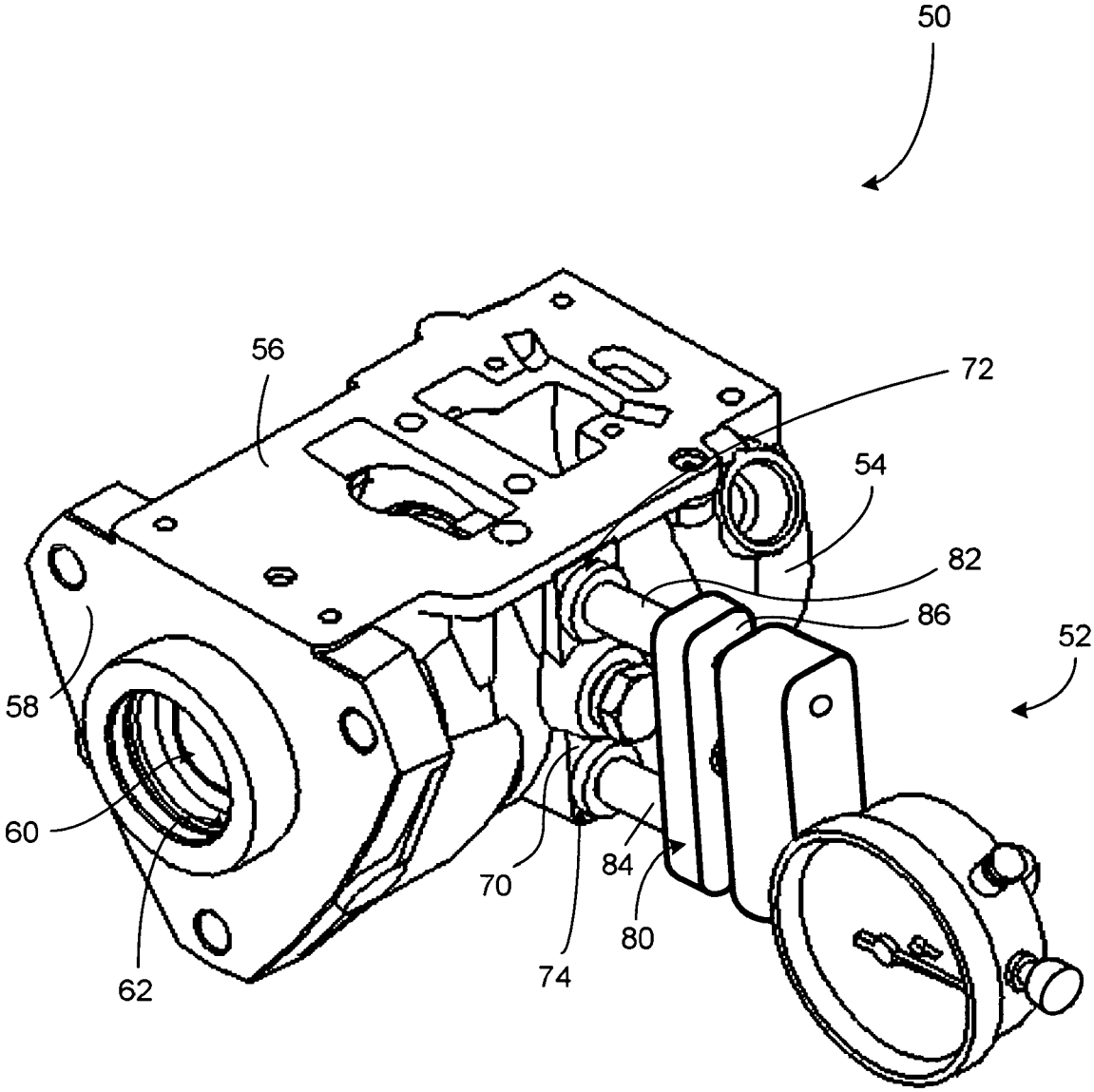
FIG. 2 is a perspective view of the housing a distributor-type fuel pump including a measurement device in accordance with an embodiment of the invention.
Figure 3:
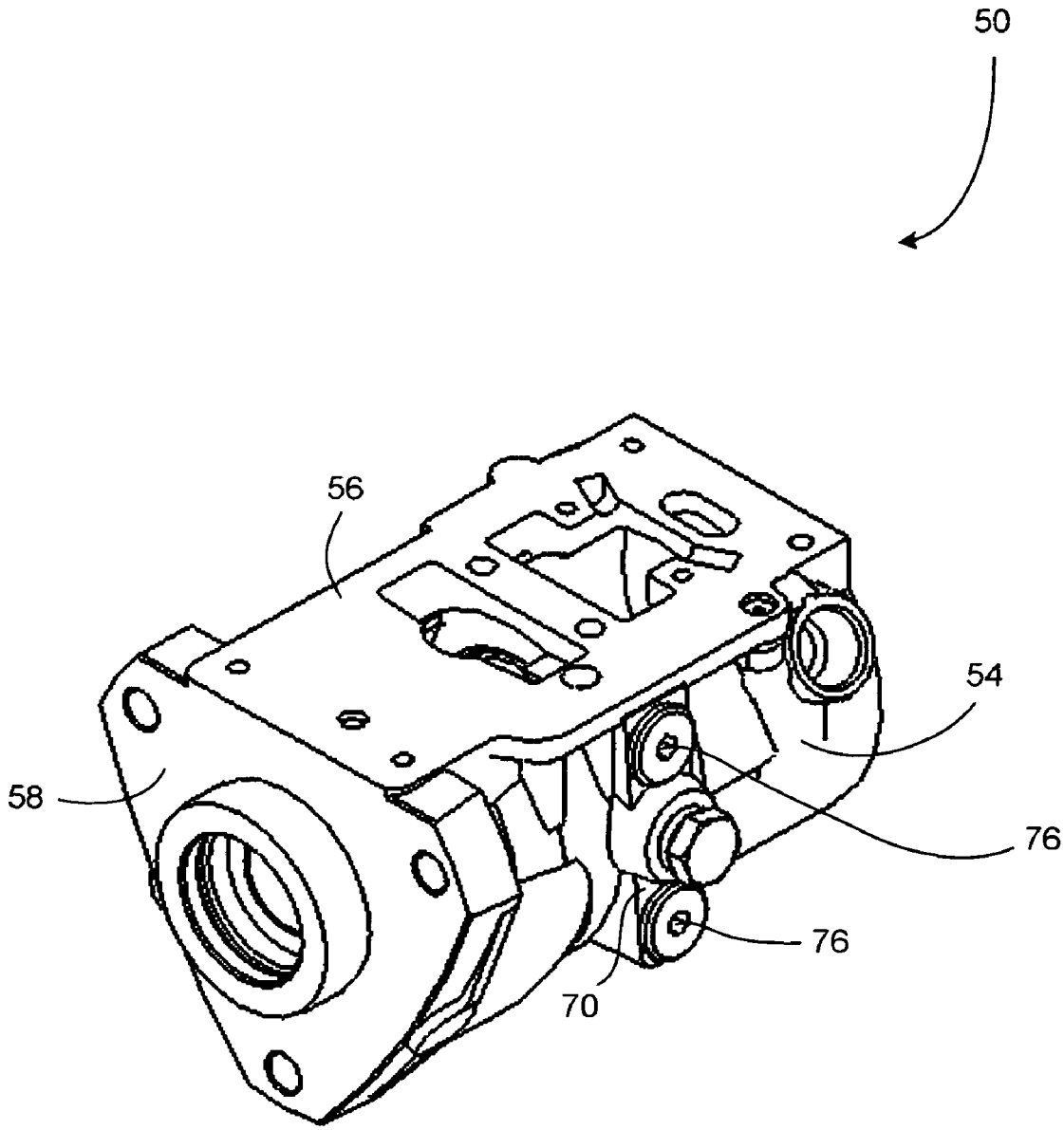
FIG. 3 is a perspective view of the housing of the distributor-type fuel pump in FIG. 2 with the measurement device removed and closure plugs fitted.
Figure 4:
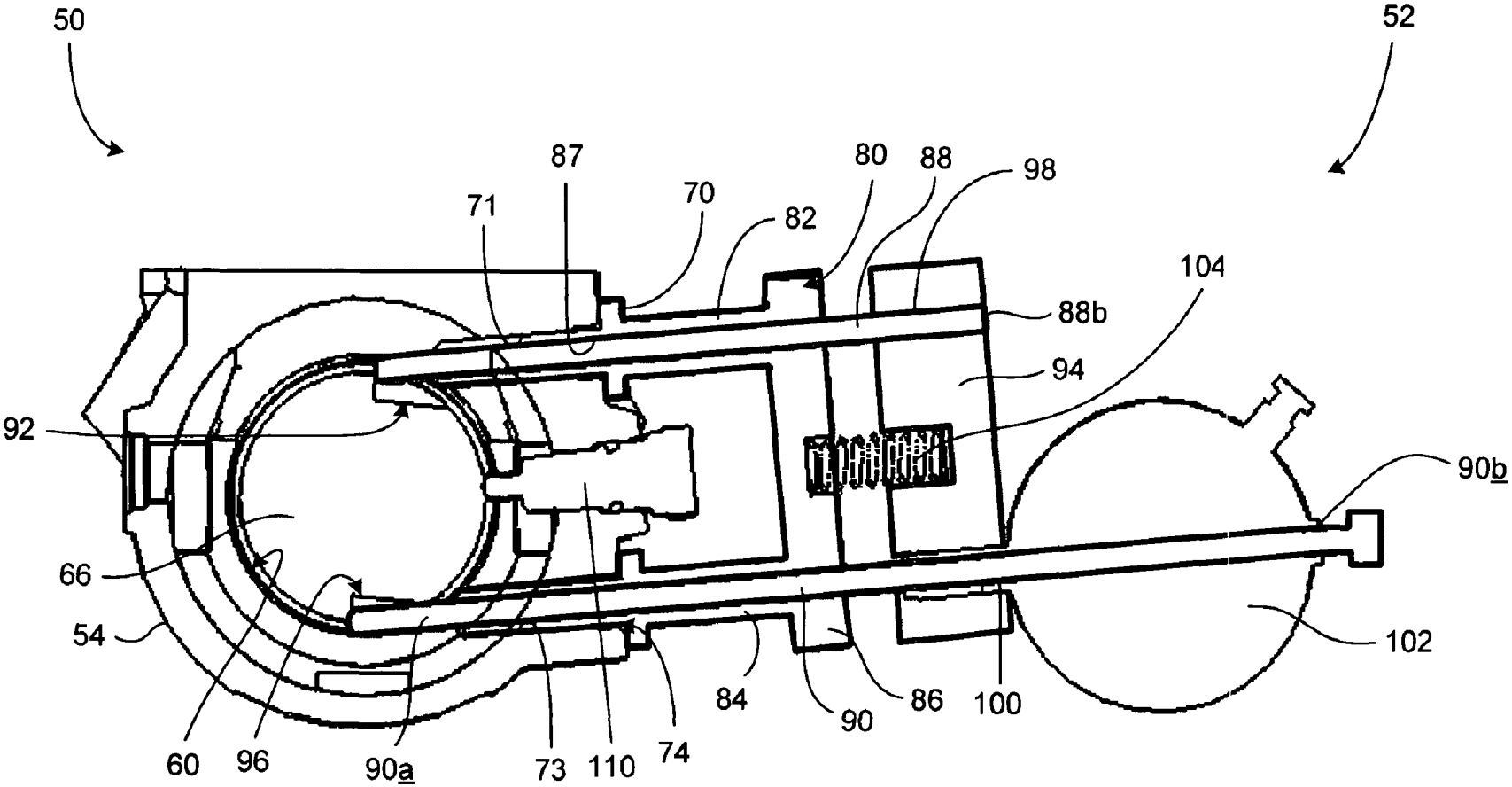
FIG. 4 is a cross-section of the distributor-type fuel pump and measurement device of FIG. 2.

Referring to FIGS. 2, 3 and 4, there is shown in general outline a distributor-type fuel pump 50 and an associated measurement device 52 in accordance with the invention. It should be mentioned at this point that the fuel pump 50 shown in the figures is not a complete and functional fuel pump and, as such, only the parts pertinent to the invention are shown and described in the foregoing description.

The fuel pump 50 comprises a pump body 54 a generally triangular end face 58 which, in use, enables the fuel pump 50 to be mounted to an engine. The configuration of the majority of the surface detail of the pump body 54 does not form part of the invention and so will not be described in further detail here.

Although not clearly shown in FIG. 2 or 3, the pump body 54 is provided with a longitudinal passage 60, one end of which defines a centrally disposed circular opening 62 in the end face 58 of the pump body 54. The longitudinal passage 60 receives a pump shaft 66 which, in use, is driven by a power take-off from the main engine crank shaft via the opening 62.

Midway along a side face of the pump body 54, there is provided a mounting piece 70, in the form of a flange, to which the measurement device 52 is mounted. The flange 70 is laterally disposed relative to the longitudinal axis of the pump body 54 and is shown in an up-right orientation in FIGS. 2, 3 and 4. The flange 70 defines first and second openings 72, 74 of respective first and second bores 71, 73 provided in the pump body 54 and mounting piece 70 by which means the measurement device 52 is mounted thereto in order to enable the angular position of the pump shaft 66 to be measured. The first, upper bore 71 and the second, lower bore 73 extend from the first and second openings 72, 74 generally laterally through the pump body 54. Each of the bores 71, 73 includes an inner end that opens into the longitudinal passage 60. However, as shown in FIG. 3, in circumstances when the measurement device 52 is removed from the pump body 54, the first and second openings 72, 74 are covered by respective closure plugs 76 which prevent ingress of debris into, and leakage of fuel from, the pump body 54.

The measurement device 52 includes a means to engage the pump body in the form of a positioning structure 80 that is provided with first and second substantially parallel leg members 82, 84 that are connected at their ends remote from the pump body 54 by an integral bridge member 86. The first and second leg members 82, 84 are received by the first and second bores 71, 73, respectively, to provide a secure mounting for the measurement device 52.

Each one of the first and second leg members 82, 84 is provided with a longitudinal through bore or drilling 87, each of which receives a respective first and second measurement member 88, 90 in the form of a rod-like probe. The first probe 88 includes an inner end region 88*a* proximal to the pump shaft 66 that protrudes from an inner end of the first leg member 82 into the longitudinal passage 60 and engages a first locating feature 92 provided on the surface of the pump shaft 66. The first probe 88 extends tangentially away from the first locating feature 92 along a first probe axis and includes an outer end region 88*b* that protrudes from the positioning structure 80 and is connected to a block-like measurement device body in the form of a gauge holder 94 in a fixed relationship.

Similarly, the second probe 90 includes an inner end region 90*a* proximal to the pump shaft 66 that protrudes from an inner end of the second leg member 84 into the longitudinal passage 60 and engages a second locating feature 96 provided on the surface of the pump shaft 66. The second probe 90 extends tangentially away from the second locating feature 92 along a second probe axis and includes an outer end region 90*b* that protrudes from the positioning structure 80 and is received by the gauge holder 94 in a sliding relationship.

The gauge holder 94 is moveable with respect to the positioning structure 80 to permit the probes 88, 90 to be engaged and disengaged from the first and second locating features 92, 96 provided on the pump shaft 66. The outer end region 88*b* of the first probe 88 is received within a first bore 98 provided in the gauge holder 94 and is secured thereto so as to define a fixed relationship therewith. Conversely, the outer end region 90*b* of the second probe 90 is received through a second bore 100 defined by the gauge holder 94 and co-operates with a dial test indicator gauge 102 in a sliding manner. Linear movement of the second probe 90 relative to the gauge holder 94 is therefore accurately measurable to a high resolution. For example, typically, the dial test indicator is provided with a measurement range of 20 mm at a resolution of 0.01 mm which enables the angular position of the shaft to be determined accurately.

The measurement device 52 is also provided with biasing means in the form a coil spring 104 located intermediate the positioning structure 80 and the gauge holder 94. The spring 104 serves to bias the gauge holder 94 away from the pump body 54, thus providing a force that acts to withdraw the inner end regions 88*a*, 90*a* of the probes 88, 90 into their respective leg members 82, 84. It should be appreciated that in FIG. 4 the gauge holder 94 is shown in a position such that the coil spring 104 is compressed, thereby extending the first and second probes 88, 90 into the longitudinal passage 60 so as to engage the probes 88, 90 with the respective first and second locating features 92, 96.

In this embodiment, each of the first and second locating features 92, 96 is a notch-like recess machined on the surface of the pump shaft 66. Since the approximate angular position of the pump shaft 54 which corresponds to the correct timing position is known, the locating features 92, 96 are selectively positioned on the surface of the pump shaft 54 such that the inner end regions 88*a*, 90*a* of the probes 88, 90 are permitted to engage the locating features 92, 96 over a range of angular rotation of the pump shaft 54. Thus, in this embodiment, the locating features are in the same axial position on the surface of the pump shaft 66 but diametrically opposed to one another i.e. circumferentially aligned in the same plane and radially spaced substantially by 180°.

It should be mentioned at this point that although it is not essential to the invention for the locating features 92, 96 to be diametrically opposed on the pump shaft 54, this arrangement permits a convenient spacing of the first and second leg members 82, 84. Moreover, arranging the locating features diametrically opposite one another permits the inner end regions 88*a*, 90*a* of the first and second measurement members 88, 90 to remain in engagement with the first and second locating features 92, 96 over a relatively large angular range of movement of the pump shaft 66, for example +/−15 degrees of rotation around the correct timing position.

The pump body 54 is also provided with a third bore 110 disposed intermediate the first and second bores 71, 73 that extends generally laterally through the pump body 54, inwardly from the face of the mounting piece 70, so as to open into the longitudinal passage 60. The intermediate bore 110 receives a shaft locking device 112 in the form of a locking bolt that is provided with a projection 114 at its inner end that extends into the longitudinal passage 60. The locking bolt 112 carries a screw thread (not shown) such that as the locking bolt 112 is screwed into the bore 110 the projection is caused to press against the outer surface of the pump shaft 66 by which means rotation of the pump shaft 66 is prevented.

In FIG. 4, the fuel pump 50 is shown as calibrated such that the correct timing position of the pump shaft 66 has been determined, the shaft 66 being locked into that position by means of the locking bolt 112. In use, the second probe 90 is arranged to adopt an extended position relative to the first probe 88 such that, as the measurement device 52 is operated, by way of a user urging the gauge holder 94 toward the positioning structure 80, the inner end 90*a* of the second probe 90 will engage the second locating feature 96 before the inner end 88*a* of the first probe 88 engages the first locating feature 92. As the gauge holder 94 is depressed, the second probe 90 will be caused to move linearly through the gauge 102 until the inner end 88*a* of the first probe 88 engages the first locating feature 92. Since the first probe 88 is not permitted to slide with respect to the gauge holder 94, the length of the first probe 88 defines a distance to which the amount of sliding movement of the second probe 90 may be referenced. Thus, the distance between the first and the second locating features 92, 96 is measured and, as a result, the exact angular position of the pump shaft 66 that corresponds to the correct timing position may be determined.

Figure 5A:
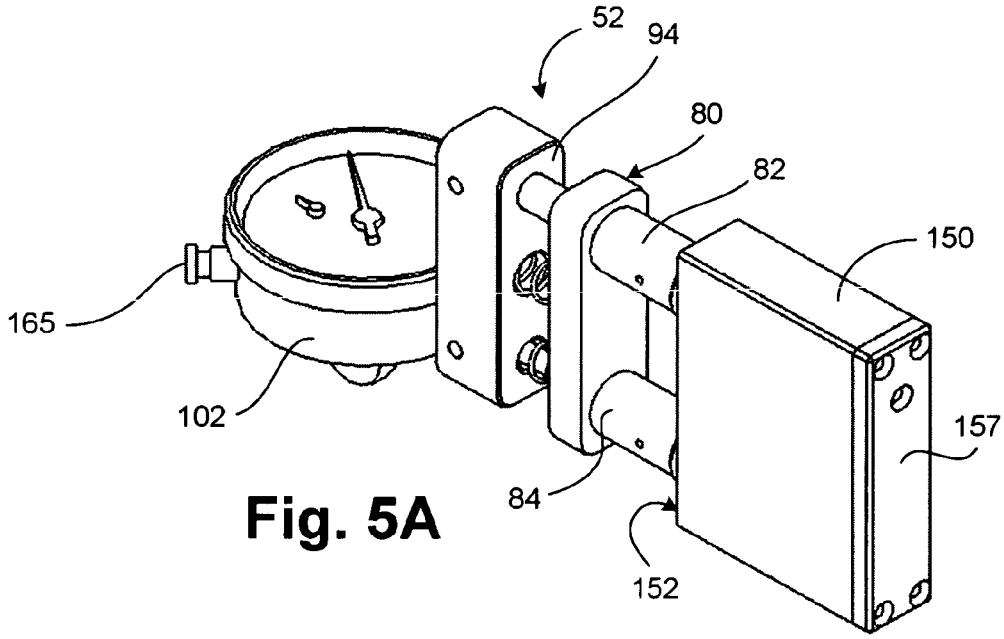
FIG. 5A is a perspective view of the measurement device installed in a device initialising means.
Figure 5B:
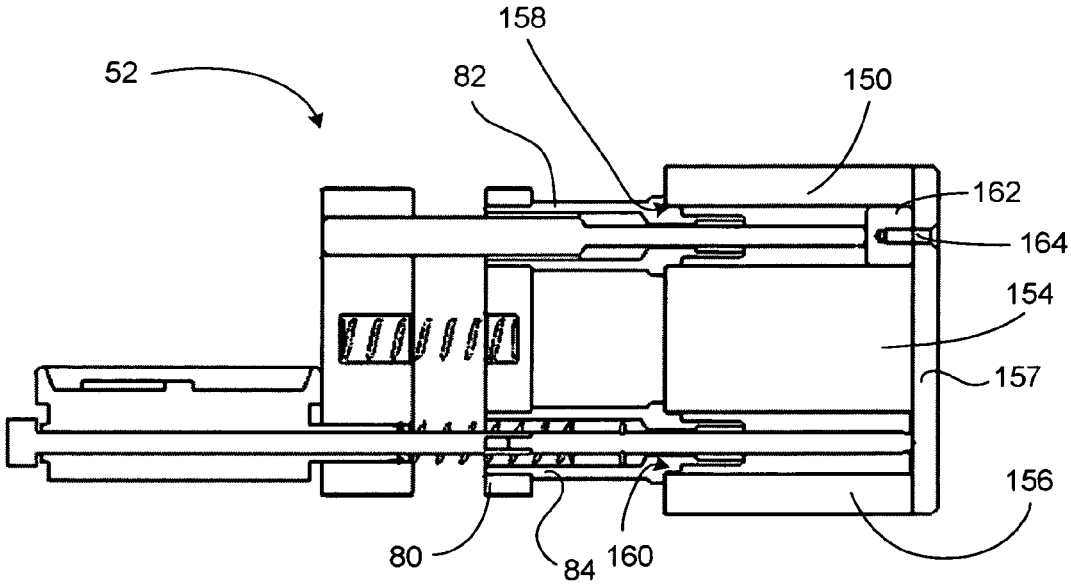
FIG. 5B is a sectional view of FIG. 5A.

It is preferred that the second probe 90 is arranged initially to adopt an extended position relative to that of the first probe 88 so that the readings taken from the gauge 102 are positive values as opposed to negative values, thus guarding against possible ambiguity when a user operates the device. To this end, and as shown in FIGS. 5A and 5B, a device initialising means in the form of a setting block 150 is provided. In this embodiment, the setting block 150 is generally cuboidal in form and defines an oblong mounting face 152. The setting block 150 is provided with first and second parallel bores 154, 156, that extend from respective openings 158, 160 provided in the mounting face 152. Other ends of the bores 154, 156 open onto an opposing face of the setting block 150 but are closed off by a cover plate 157 that is fastened to the setting block 150 by rivets or screws. The first and second bores 154, 156 receive a respective one of the first and second legs 82, 84 of the positioning structure 80, thus permitting the measurement device 52 to be mounted to the setting block 150.

The first bore 154 (shown in an uppermost position in FIG. 5B) of the setting block 150 is provided with a spacer piece 162 at its blind end which is attached to the cover plate 157 by a screw 164 so as to hold the spacer piece 162 in position. The spacer piece is configured to have a predetermined thickness, for example 10 mm, such that the available depth of the first bore 154 is less than the available depth of the second bore 156.

As shown in FIG. 5B, the measurement device 52 is mounted to the setting block 150 and the gauge holder 94 operated to engage the inner ends 88*a*, 90*a* of the measurement members 88, 90 with the blind ends of the respective bores 71, 73. In this position, the gauge 102 is reset, or 'zeroed' by unlocking a clamp screw 165 so as to enable rotation of the dial face to establish a datum position.

As has been mentioned, in order for the inner ends 88*a*, 90*a* of the measurement members to remain engaged with the first and second locating features 92, 96, respectively, the pump shaft 66 may only move through a limited range of rotation, approximately +/−15 degrees, about the correct timing position. Providing the setting piece 162 enables the measurement device 52 to be calibrated to a predetermined datum such that positive values are provided by the gauge 102 throughout the full range of movement of the pump shaft 66.

One benefit provided by the invention is that, following calibration of the fuel pump 50, the reading from the gauge 102 may be recorded against the manufacturing part number of the fuel pump 50 and archived so as to be available for subsequent referral. Thus, each fuel pump that is manufactured will have a reading associated therewith indicating its correct timing position. In addition to the "archived value" of the correct timing position used by the fuel pump manufacturer, the value may also be marked on the outer surface of the fuel pump, for example etched onto the pump casing or printed on a data plate. The details of the correct timing position are therefore available for the purposes of verifying the correct timing position when the pump is installed on an engine by a vehicle manufacturer, or when re-setting the timing position when the fuel pump is removed from the engine during a maintenance event.

A particular advantage of the invention is that since the difference between the first and second distances (defined by the first and second measurement members, respectively) is measured, the value provided by the gauge 102 is substantially unaffected by lateral play of the pump shaft 66 due to the bearings of the shaft. Similarly, the measurement device 52 is insensitive to vertical 'float' in the bearings.

Further, since the measurement device 52 determines the distance of the second locating feature 96 relative to the first locating feature 92, any part-to-part variations in the components of the pump are included in the measurement reading. Thus, although the measurement device 52 must be manufactured accurately, less tight tolerances are permissible for the pump components, thus reducing unit costs. The measurement device 52 is also compatible with existing fuel pump designs, such designs requiring only relatively minor structural modifications to allow the measurement device 52 to mount onto the pump (for example, the provision of the bores 71, 73 and the locating features 92, 96).

If the fuel pump 50 has to be removed from the pump shaft 66 for maintenance purposes, then in order to re-set the correct timing position, the pump shaft 66 is first rotated into approximately the desired position. The measurement device 52 is then mounted to the fuel pump 50 and operated by a user until the first and second probes 88, 90 engage the first and second locating features 92, 96, following which the pump shaft 66 is rotated until the gauge reading corresponds with the archived value. When the correct timing position of the pump shaft 66 is obtained, the pump shaft 66 must be locked to prevent further rotation prior to the fuel pump being re-installed on the engine.

In this alternative mode of operation, the invention provides a convenient and cost efficient way for an engine manufacturer, for example, to re-calibrate the fuel pump 50 into its predetermined correct timing position. In known fuel pumps, it would be necessary to return the fuel pump to the pump manufacturer to carry out the re-calibration process.

In general, many variations are possible within the inventive concept. For example, although the above described embodiment includes a measurement device 52 having first and second measurement members 88, 90 that are inserted into the respective bores 71, 73 of the pump body at the same time, the invention also encompasses a measurement device comprising a single measurement member. Such a measurement device with a single measurement member is useful where access to the fuel pump in-situ is limited.

Figure 6:
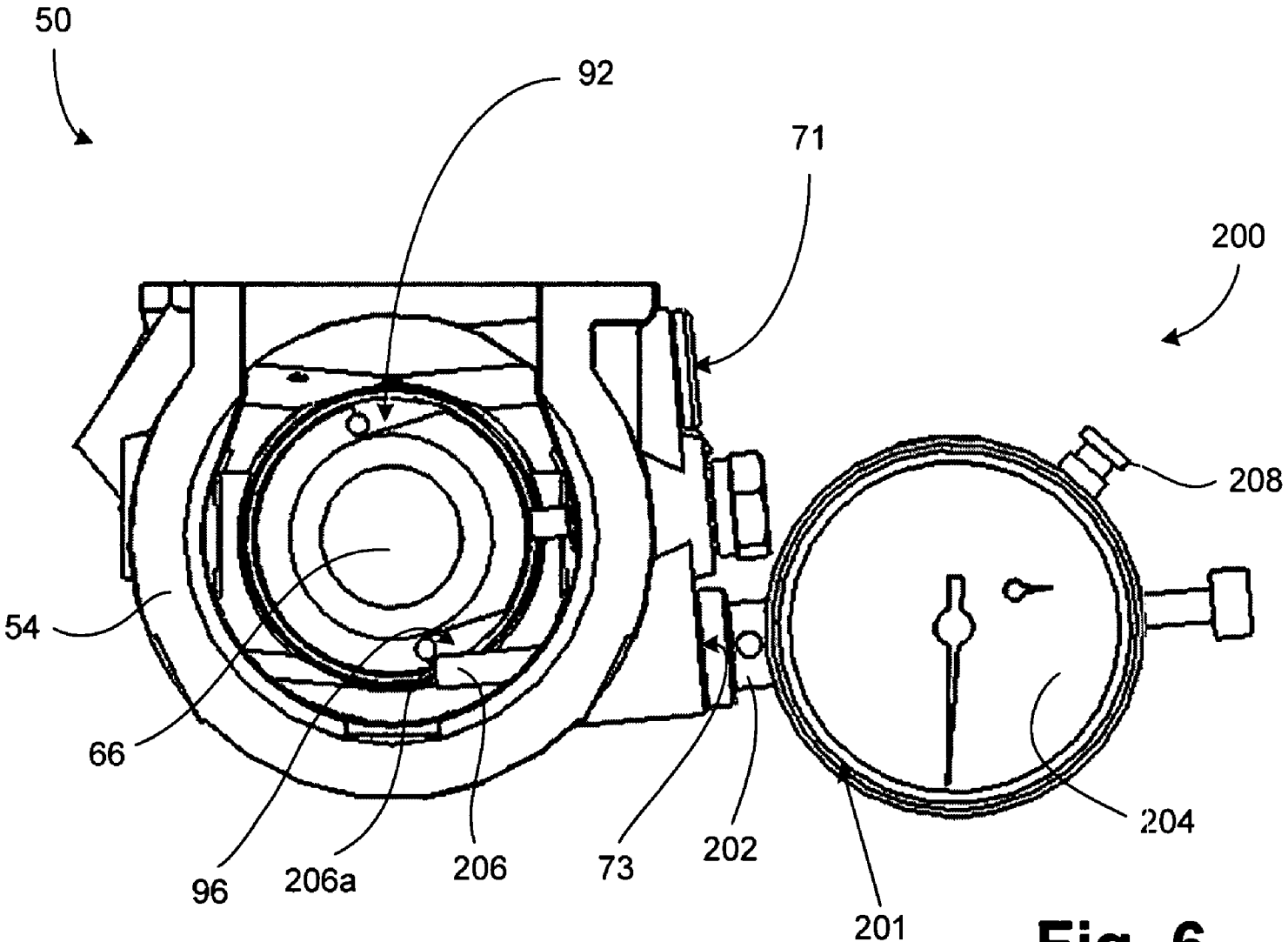
FIGS. 6 and 7 are part-sectional views of the housing of a fuel pump and a measurement device of an alternative embodiment of the invention.
Figure 7:
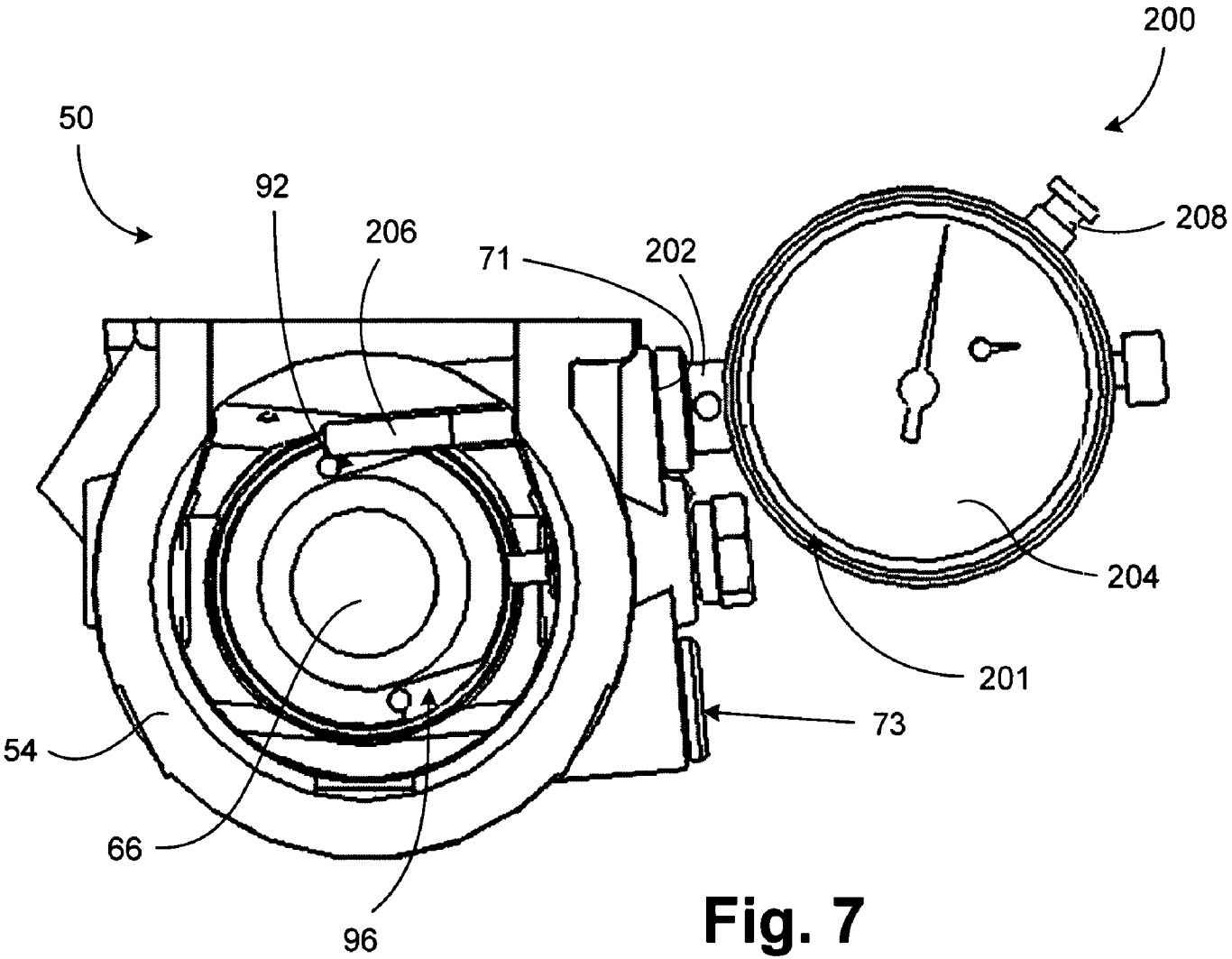

Therefore, the invention provides an alternative embodiment shown in FIGS. 6 and 7, in which a measurement device 200 includes a measurement device body 201 having a single leg member 202 being engageable with the first bore 71 or the second bore 73 of the fuel pump 50. It should be appreciated that the fuel pump 50 shown in FIGS. 6 and 7 is identical to that which has been described with respect to the previous embodiment and so will not be described again here.

The measurement device includes a measurement gauge 204 connected to the leg member 202, the gauge 204 having a single measurement member 206 associated therewith, an inner end 206*a* of which is co-operable with either the first or second locating features 92, 96 when appropriately mounted to the pump body 54.

In this embodiment, in order to obtain an accurate measurement of the angular position of the pump shaft 66, it is necessary to perform a two-part operation in which the leg member 202 of the measurement device 200 is inserted into each of the bores 71, 73 of the pump body 54 in turn.

Prior to the measurement device 200 being mounted to the fuel pump 50, the measurement member 206 adopts a fully extended position, at which position the gauge 204 is zeroed, by way of the clamp screw 208, thus defining a datum position. It would be appreciated by the skilled reader that the measurement probe of a conventional dial test indicator adopts a fully extended position with respect to the gauge body and measures the linear distance that the end of the probe is moved towards the gauge.

In FIG. 6, the pump shaft 66 is shown in the region of its correct timing position and the inner end 206*a* of the measurement member 206 is engaged with the second locating feature 96. Thus, the measurement member 206 is shown shifted from its datum position by a first distance along the axis defined by the measurement member 206. The first distance is measured by the gauge to a high accuracy (the typical resolution of a dial test indicator is 0.01 mm) and the reading is recorded by the user as a reference value.

FIG. 7 shows the second operation in which the measurement device 200 is removed from the second, lower bore 71 and engaged with the first, upper bore 73. The measurement member 206 is thus moved from its datum position by a second distance along the axis defined by the measurement member 206. The second distance is measured by the gauge 204 and the reading is recorded by the user. In order to determine an accurate value for the angular position of the pump shaft 66, the first, reference value is subtracted from the second value, which provides the distance between the first and second locating features 92, 96 measured along parallel axes defined by the measurement member 206. It will be appreciated that in some circumstances the above arithmetic step may result in a negative value which is undesirable to avoid possible ambiguity to the operator of the measurement device. To avoid this, a predetermined nominal value (for example 10 mm) is added to the aforementioned arithmetic operation so as to ensure the resulting value is positive.

It will be appreciated that it would be also possible to obtain an indication of the angular position of the pump shaft 66 merely using a single measurement operation of the measurement device 200. However, the value obtained by a single reading is inaccurate since the reading displayed by the gauge 204 is susceptible to play in the bearings in which the pump shaft 66 is mounted. Moreover, a 'double sided reading', i.e. measuring the difference in position between the first and second locating features 92, 96, is substantially twice as sensitive as a 'single sided reading' since as the pump shaft 66 rotates, the first and second locating features 92, 96 move in opposite directions by the same amount.

In the above embodiments, the first and second locating features 92, 96 are described as notches or recesses provided on the surface of the pump shaft 66 that are circumferentially aligned in the same plane and diametrically opposed i.e. radially spaced by substantially 180°. However, this need not be the case and the locating features 92, 96 may, for example, be diametrically opposed but spaced apart at different axial positions on the surface of the shaft. Alternatively, the locating features need not be diametrically opposed but may be spaced apart radially by less than 180°. The important factor is that the locating features 92, 96 are positioned so as to be generally aligned with the inner openings of the upper and lower bores 71, 73 when the pump shaft 66 is within a predetermined rotational range of the correct timing position.

Also, although in FIGS. 4, 5A, 5B, the second measurement member 90 and in FIGS. 6 and 7 the measurement member 206 are illustrated as a unitary rod-like member, the measurement members 90, 206 could also be constructed as one or more sections. For example, a typical dial test indicator is provided with a relatively short measuring probe. Therefore, in an alternative embodiment (not shown), the measurement member 90, 206 comprises a separate probe piece connected to and extending from the relatively short probe provided by the gauge.

Although in the embodiment of FIGS. 2 to 5 it is a feature that the first measurement member 88 is immovably fixed to the gauge holder 94 and the second measurement member 90 is moveable with respect to the gauge holder 94, it should be appreciated that this need not be the case. In an alternative embodiment (not shown), for example, the first measurement member 88 is moveable with respect to the gauge holder 94 and the second measurement member 90 is carried in a fixed relationship thereto.

A still further variation on the inventive concept is illustrated in FIGS. 8, 9A, 9B and 10 which utilises a single measurement member. The fuel pump 50 in this embodiment is identical to that which has been described with respect to the previous embodiments and so will not be described again in detail here. Where appropriate, however, like parts are denoted by like reference numerals. This embodiment provides a simplified measuring apparatus which is particularly suited for use in the field where sensitive measurement gauges, such as DTIs, may be vulnerable to shock damage. Moreover, standard mechanical or digital vernier callipers may be used with this particular embodiment which reduces the costs of supplying such a unit.

Figure 8:
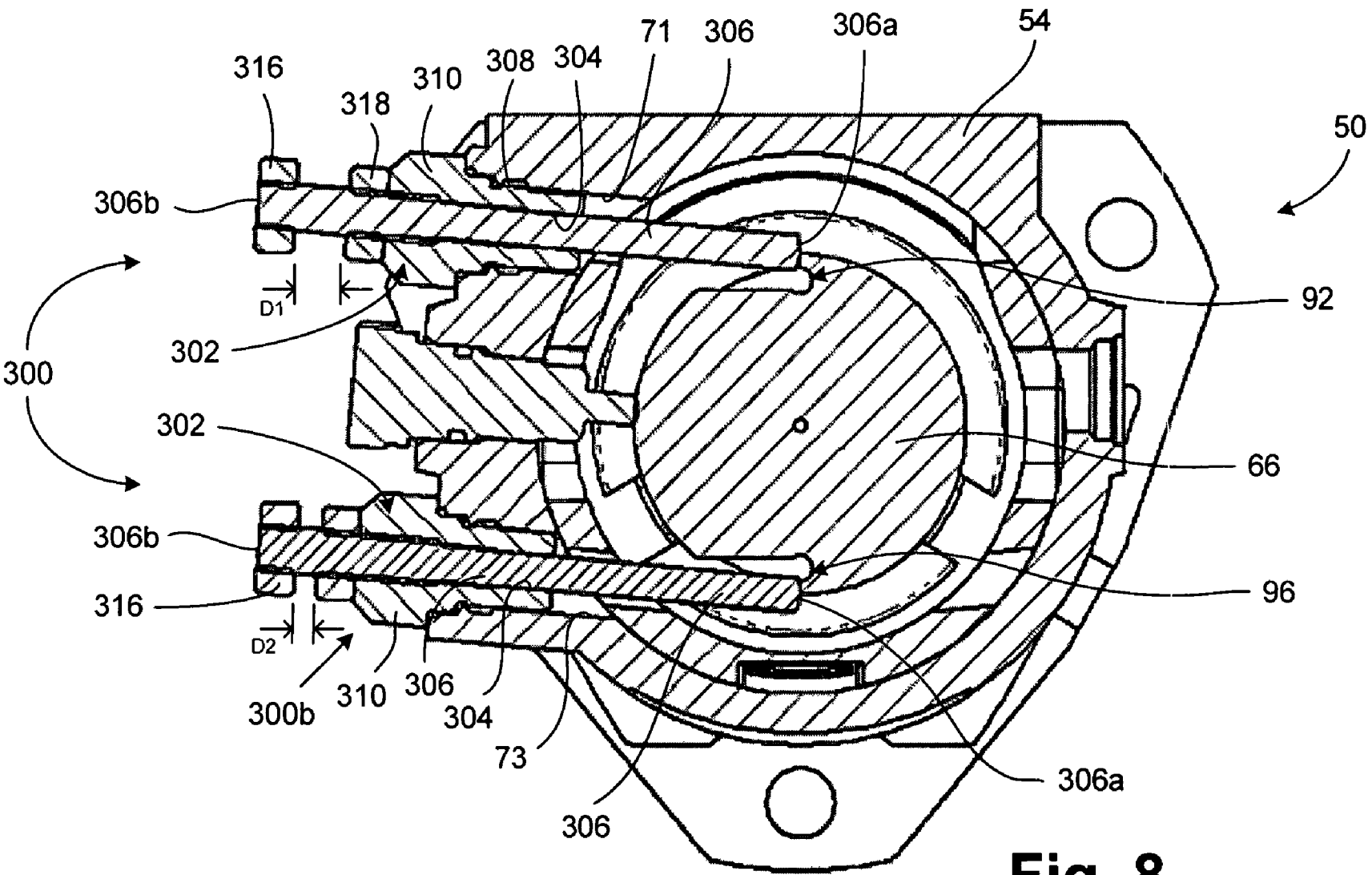
FIG. 8 is a cross-section of the housing of a distributor-type fuel pump and measurement device of a further alternative embodiment of the invention.

FIG. 8 shows alternative means for measuring the angular position of the pump shaft 66 that provides first and second identical measurement devices 300. An upper one of the measuring devices 300*a* is received in the upper bore 71 of the pump body 54 and a lower one of the measuring devices 300*b* is received in the lower bore 73.

Figure 9A:
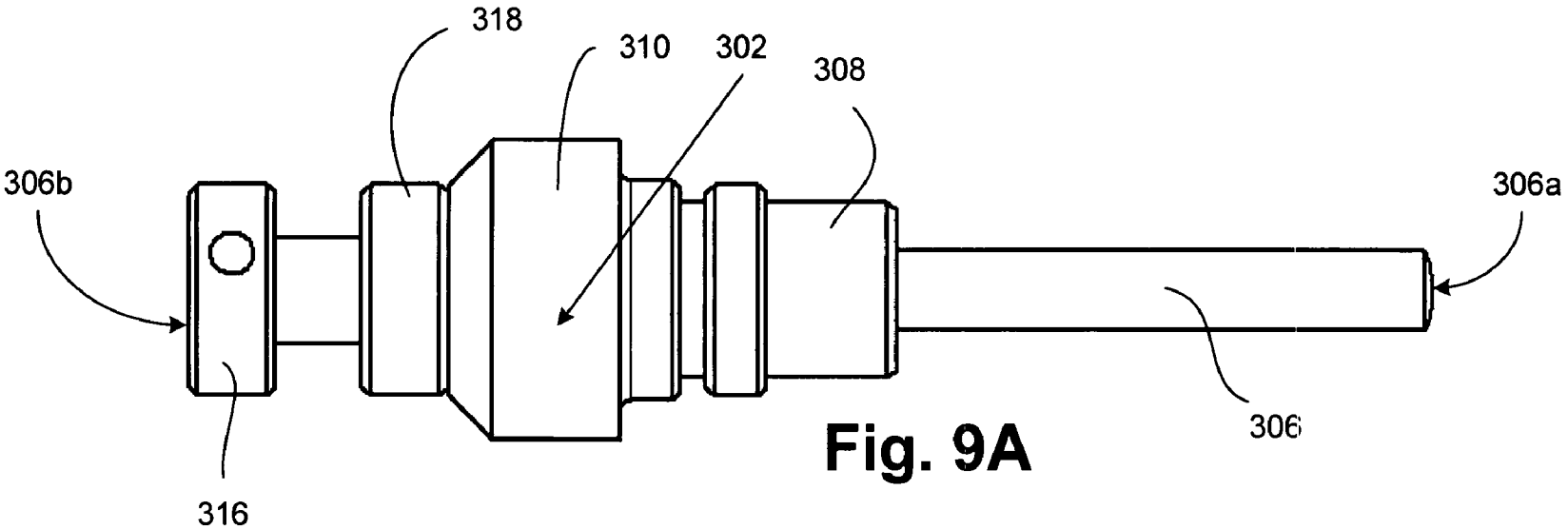
FIGS. 9A and 9B are side views and cross-sectional views, respectively of the measurement device of FIG. 8.
Figure 9B:
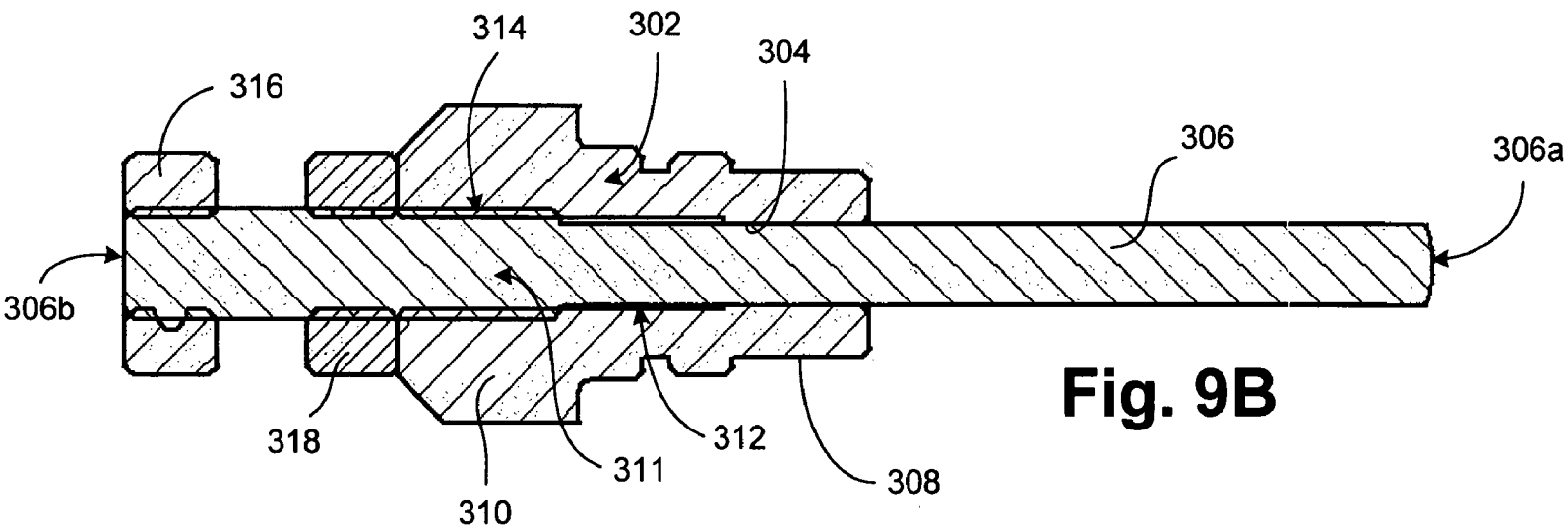
Figure 10:
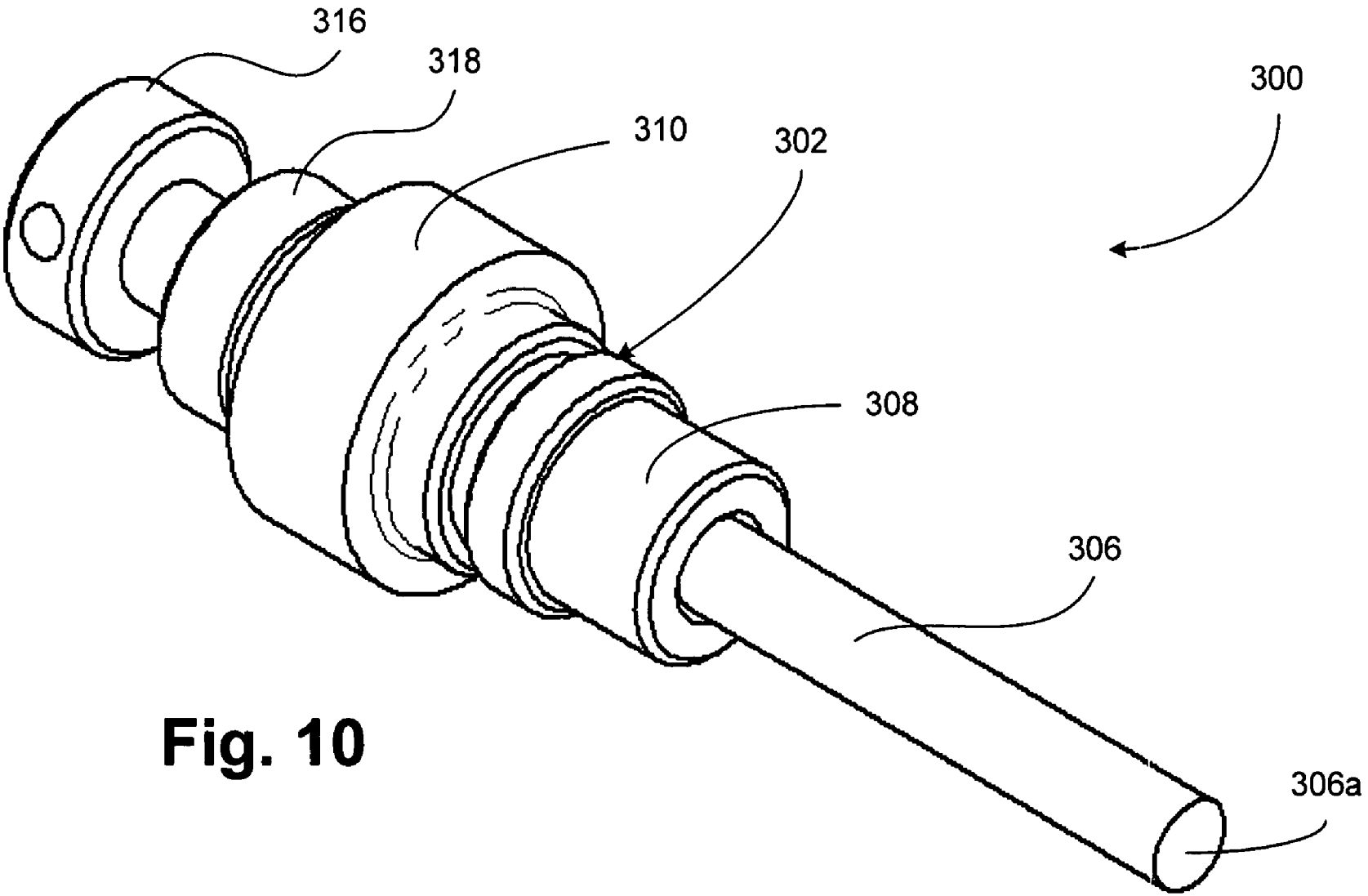
FIG. 10 is a perspective view of the measurement device of FIGS. 9A and 9B.

Referring also to FIGS. 9A, 9B and 10, which show the measuring device 300 more clearly, it can be seen that the measuring device 300 includes a centrally disposed bolt-like positioning member 302 having a through-bore 304 through which an elongate measurement member 306 extends. Inner and outer ends 306*a*, 306*b* of the measurement member 306 protrude out of either end of the positioning member 302 (shown to the right and left of FIGS. 9A and 9B, respectively). As in previously described embodiments, the measurement member 306 is in the form of a slim rod-like probe.

A shank 308 of the positioning member 302 is provided with an external screw thread (not shown) that is engageable with an internal screw thread (also not shown) provided in the bores 71, 73 of the pump body 54. A head region 310 of the positioning member 302 has a larger diameter than the shank 308 and provides a gripping surface for a user to tighten the positioning member 302 in the bores 71, 73. It should be appreciated that although the shank 308 and internal surface of the bores 71, 73 could be smooth, thus engaging by way of a press-fit, engaging these components by way of a screw fit is currently preferred so as to ensure measurement accuracy.

The bore 304 of the positioning member 302 is provided with an internal screw thread 312 along approximately two-thirds of its length which cooperates with an externally threaded region 314 provided on a middle portion 311 of the measurement member 306. Therefore, rotation of the measurement member 306 relative to the positioning member 302 is converted to linear movement such that the inner end 306*a* of the measurement member 306 moves axially inward or outward depending on the direction of rotation.

The outer end 306*b* of the measurement member 306, distal from the pump shaft 66, carries a fixed annular collar 316 which provides a convenient gripping point for a user to rotate the measurement member 306. The measurement member 306 also carries a locking ring 318, located between the annular collar 316 and the positioning member 302, which is co-operable with the threaded middle portion 311 of the measurement member 306. As is shown in FIGS. 8 to 10, the locking ring 318 is screwed up to abut the positioning member 302 to prevent further rotation of the measurement member 306. The measurement member 306 is thus in a fixed axial position.

In order to determine the angular position of the pump shaft 66, a measurement device 300 is inserted into each of the upper and lower bores 71, 73 of the pump body 54 and the positioning member 302 is screwed into finger-tight engagement. Although not shown in FIG. 8, initially the locking ring 318 is screwed out fully such that it abuts the annular collar 316.

Following insertion of the measurement devices 300 into the upper and lower bores 71, 73, each measurement member 306 is rotated relative to the positioning member 302 until the inner end 306*a* engages its respective locating feature 92, 96. In order to prevent further rotation of the measurement member 306, the locking ring 318 is screwed down to abut the positioning member 302. This is the position shown in FIG. 8.

When the locking ring 318 is in abutment with the positioning member 302, a gap exists between the opposing faces of the annular collar 316 and the locking ring 318. On FIG. 8, the gap on the upper measuring device 300*a* is labelled as D1 and the gap on the lower measuring device 300*b* is labelled as D2. The size of each gap D1, D2 is measured by a pair of vernier callipers to provide an upper reading R1 and a lower reading R2. Of course, although mechanical or digital vernier callipers are particularly suited to measuring the gaps D1, D2, this does not preclude other gauges from being used for the same purpose. However, in order to provide the necessary accuracy, it is preferred that any such gauge should have a resolution of at least 0.01 mm.

In order to determine an accurate value for the angular position of the pump shaft 66, the upper reading R1 is subtracted from the lower reading R2, which provides the distance between the first and second locating features 92, 96 measured along parallel axes defined by the measurement members 306. It will be appreciated that in some circumstances the above arithmetic step may result in a negative value which is undesirable to avoid possible ambiguity to the operator of the measurement device. To avoid this, a predetermined nominal value (for example 10 mm) is added to the aforementioned arithmetic operation so as to ensure the resulting value is positive.

Although two measurement devices 300 are used in the above procedure, it should be appreciated that it is also possible to perform the same measurement with a single measurement device which is engaged first in the upper bore 71, and a reading R1 taken, and then in the lower bore 73, and a reading R2 taken. The calculation described above is then carried out to deduce the angular position of the pump shaft.

The invention claimed is:

1. A method for determining the angular position of a pump shaft relative to a pump body, the method comprising:

providing the pump shaft with a first locating feature, providing the pump shaft with a second locating feature, providing a measurement device provided with a measurement member, wherein the measurement device is mounted on the pump body and does not use electricity to indicate the measurement, engaging the measurement member with the first locating feature and determining a first distance between the first locating feature and a reference feature provided on the measurement device, wherein engaging the measurement member with the first locating feature prevents rotation of the pump shaft, engaging the measurement member with the second locating feature and determining a second distance between the second locating feature and a reference feature provided on the measurement device, wherein engaging the measurement member with the second locating feature prevents rotation of the pump shaft, determining the difference between the first and second distances to provide an indication of the angular position of the pump shaft relative to the pump body.

2. The method of claim 1, wherein the pump shaft has a predetermined correct timing position and wherein the pump shaft is locked into the correct timing position prior to engaging the measurement member with the first and second locating features, respectively.

3. The method of claim 1, wherein following the steps of engaging the measurement member with the first and second locating features, respectively, the angular position of the pump shaft is adjusted so as to move the pump shaft to a position corresponding to a predetermined correct timing position.

4. The method of claim 3, wherein the pump shaft is locked against further rotation following the step of adjusting the pump shaft to the predetermined correct timing position.

5. The method of claim 1, wherein the step of engaging the measurement member with the first and second locating features, respectively, includes inserting the measurement member into first and second openings provided in the pump body.

6. The method of claim 1, wherein the measurement device is provided with first and second measurement members and wherein the engagement step comprises engaging the first measurement member with the first locating feature and engaging the second measurement member with the second locating feature.

7. The method of claim 6, wherein the step of engaging the first and second measurement members includes moving the device body with respect to the pump body.

8. Apparatus comprising a pump having a rotatable pump shaft and a measuring arrangement for providing an indication of the angular position of the pump shaft relative to a pump body, the measuring arrangement including a device for: i) measuring a first distance between a reference feature provided on the pump body and a first locating feature provided on the pump shaft, and ii) measuring a second distance between the reference feature and a second locating feature provided on the pump shaft, wherein the first and second locating features are embodied as notch-like recesses on the pump shaft surface; and wherein the device is mounted on the pump body and does not use electricity to indicate the measurement, and wherein the measuring arrangement prevents rotation of the pump shaft when measuring the first distance and the second distance.

9. The apparatus of claim 8, wherein the measuring arrangement includes a device for measuring the difference between the first and second distances to provide the indication of the angular position of the pump shaft relative to the pump body.

10. The apparatus of claim 8, wherein the first and second locating features are disposed at the same axial position on the pump shaft.

11. The apparatus of claim 8, wherein the first and second locating features are diametrically opposed on the pump shaft.

12. The apparatus of claim 8, wherein the pump body is provided with first and second bores, each bore having an axis in alignment with a respective one of the first and second locating features.

13. The apparatus of claim 12, wherein the measuring arrangement includes a measuring device for receipt within the first bore so as to measure the distance between the reference feature provided on the pump body and the first locating feature provided on the pump shaft.

14. The apparatus of claim 12, wherein the measuring arrangement includes a measuring device for receipt within the second bore so as to measure the distance between the reference feature provided on the pump body and the second locating feature provided on the pump shaft.

15. The apparatus of claim 12, wherein the measuring arrangement includes first and second measuring devices, each of which is engageable with a corresponding one of the first and second bores provided in the pump body so as to measure, respectively, the distance between the reference feature provided on the pump body and the first and second locating features provided on the pump shaft.

16. The apparatus of claim 13, wherein the or each measuring device includes a measurement member associated therewith, the measurement member having a first end co-operable with the first or second locating features.

17. The apparatus of claim 13, wherein each measuring device includes a positioning member provided with an external screw thread for securely engaging the corresponding bore of the pump body.

18. The apparatus of claim 17, wherein the positioning member includes a passage for receiving a measurement member, the measurement member being moveable relative to the positioning member.

19. The apparatus of claim 18, wherein the measurement member carries a locking member which, when in a locked position, prevents angular movement of the measurement member relative to the positioning member.

20. The apparatus of claim 12, wherein the measuring arrangement includes a measuring device having first and second measurement members associated therewith, wherein the first measurement member has a first end co-operable with the first locating feature and the second measurement member has a first end co-operable with the second locating feature.

21. The apparatus of claim 12, wherein the measuring arrangement includes a positioning structure provided with first and second leg members, the first leg member being received within the first bore and slidably receiving a first measurement member and the second leg member being received within the second bore and slidably receiving a second measurement member.

22. The apparatus of claim 21, wherein a second end of the first measurement member protrudes from the positioning structure and attaches to a measuring device body in a fixed manner.

23. The apparatus of claim 22, wherein a second end of the second measurement member protrudes from the positioning structure to connect with the device body in a moveable manner.

24. The apparatus of claim 22, wherein the device body is moveable with respect to the positioning structure to permit the first and second measurement members to be engaged and disengaged with the first and second locating features, respectively.

25. The apparatus of claim 23, wherein the device body is moveable with respect to the positioning structure to permit the first and second measurement members to be engaged and disengaged with the first and second locating features, respectively.

26. The apparatus of claim 24, wherein the device body is biased away from the positioning structure so as to urge the first and second measurement members to disengage from the first and second locating features, respectively.

27. The apparatus of claim 25, wherein the device body is biased away from the positioning structure so as to urge the first and second measurement members to disengage from the first and second locating features, respectively.

28. The apparatus of claim 20, wherein the device body includes a measurement gauge operable to measure the amount that the second measurement member moves linearly with respect to the device body.

29. The apparatus according to claim 28, wherein the measurement gauge is referenced to the first distance.

* * * * *